US006869077B1

(12) United States Patent
Ozmulla et al.

(10) Patent No.: US 6,869,077 B1
(45) Date of Patent: Mar. 22, 2005

(54) METHOD FOR PLAYING A MODIFIED BLACKJACK CARD GAME

(76) Inventors: Hasan Ozmulla, 58B Jennifer Pl., Staten Island, NY (US) 10314; Nathan Herskovitz, 609 Rockaway Ave., Valleystream, NY (US) 10314

( * ) Notice: Subject to any disclaimer, the term of this patent is extended or adjusted under 35 U.S.C. 154(b) by 0 days.

(21) Appl. No.: 10/825,704

(22) Filed: Apr. 16, 2004

(51) Int. Cl.[7] ..... A63F 1/00
(52) U.S. Cl. ..... 273/292; 273/274
(58) Field of Search ..... 273/292, 274, 273/309; 463/12

(56) References Cited

U.S. PATENT DOCUMENTS 5,407,209 A * 4/1995 Prerost ..... 273/292
5,944,314 A 8/1999 Stavinsky ..... 273/292
5,984,310 A 11/1999 English ..... 273/292
6,070,875 A * 6/2000 Boylan et al. ..... 273/292
6,302,396 B1 10/2001 Eaton ..... 273/274
6,592,125 B1 7/2003 Lizak ..... 273/292
6,598,880 B2 7/2003 Addabbo ..... 273/306
6,634,645 B1 10/2003 Yuan ..... 273/292
6,776,416 B1 * 8/2004 Jackson ..... 273/292

* cited by examiner

*Primary Examiner*—Benjamin Layno
(74) *Attorney, Agent, or Firm*—Goldstein Law Offices, P.C.

(57) ABSTRACT

A method for playing a modified blackjack card game that utilizes a standard deck of playing cards. The game begins with each of the players placing a bet. The dealer deals a hand of two cards to each of the players and to the dealer. After the dealer has dealt a player a second card, the player can have the dealer replace the second card with a new second card, for an amount equal to a portion of the player's bet, and preferably one-half of the player's bet, thereby giving the player more choices in the game. Moreover, the rules of the game provide for less of a chance of a tie between the dealer and the players, thereby increasing the pace and excitement of the game.

9 Claims, No Drawings

METHOD FOR PLAYING A MODIFIED BLACKJACK CARD GAME

BACKGROUND OF THE INVENTION

1. Field of the Invention

The invention generally relates to a method for playing a card game, and in particular relates to a method for playing a modified blackjack card game.

2. Description of the Related Art

Blackjack is a card game enjoyed by millions of people throughout the world. The game of blackjack is played with a deck of playing cards, each card having either a letter (A, J, Q, or K), or a number ranging between two and ten, and each card further being characterized by a symbol of one of four suits (clubs, spades, hearts, and diamonds) present in the deck of cards. During a game of blackjack, the players place their bets, and then the dealer deals a "hand" of two cards to each of the players and to the dealer. If the numerical value of the player's hand is greater than the numerical value of the dealer's hand, but less than or equal to a numerical value of twenty-one, the player wins the game, and the dealer must pay the player an amount equivalent to the bet of the player or twice the bet of the player, depending on the exact nature of the player's hand. If the player and the dealer have hands having equivalent numerical values, neither the dealer nor the player wins the game. Although blackjack is a tremendously popular and exciting casino game for millions of players, it has several notable limitations. In particular, in a standard game of blackjack, when the dealer has dealt a player a second card, the player is "stuck" with that card, and must decide whether to take a third, additional card based on the combined numerical value of the first two cards. This feature unduly limits the choices of the players. Moreover, the Kings, Queens, Jacks, and cards having the number "ten" thereupon are all of equivalent numerical value. This feature of a standard game of blackjack results in a large number of tied games, which makes for a less interesting and exciting card game. Accordingly, there is a need for a method for playing a modified blackjack card game utilizing a standard deck of cards, wherein after the dealer has dealt a player a second card, the player can have the dealer replace the second card with a new second card, for an amount equal to a portion of the player's bet, and preferably one-half of the player's bet, thereby giving the player more choices in the game, and wherein the Kings, Queens, Jacks, and cards having the number "ten" thereupon have an "actual value" which is different from their numerical value of ten, in order to resolve a tie between the dealer and the players, thereby making the game more interesting and exciting.

A variety of games based upon a deck of playing cards have been devised. For example, U.S. Pat. No. 5,944,314 to Stavinsky appears to show a method for playing a card game where players make wagers of money and plays against the dealer to determine whether the player wins or loses the wager. Additionally, U.S. Pat. No. 5,984,310 to English appears to show a method of playing a casino-type of wagering card game. Moreover, U.S. Pat. No. 6,302,396 to Eaton et al appears to show a method of playing a wagering game with a deck of numerical cards and a table layout for playing the game. Furthermore, U.S. Pat. No. 6,592,125 to Lizak appears to show a game of chance comprising Aces, Kings, Queens, and Jacks, along with at least one numerical card. What's more, U.S. Pat. No. 6,598,880 to Addabbo appears to show a card game comprised of specialized card decks and methods of play. Also, U.S. Pat. No. 6,634,645 to Yuan appears to show a method of play for a casino card game.

While these methods for playing card games may be suitable for the particular purpose employed, or for general use, they would not be as suitable for the purposes of the present invention as disclosed hereafter.

SUMMARY OF THE INVENTION

It is an object of the invention to provide a method for playing a modified blackjack card game that gives the player more choices while playing the game. Accordingly, after the dealer has dealt a player a second card, the player can have the dealer replace the second card with a new second card, for an amount equal to a portion of the player's bet, and preferably one-half of the player's bet, thereby giving the player more choices while playing the game.

It is another object of the invention to provide a method for playing a modified blackjack card game that is more quickly paced and provides more excitement to the players. Accordingly, the method provides for less of a chance of a tie between the dealer and the players, and thereby increases the pace and excitement of the game.

It is yet another object of the invention to provide a method for playing a modified blackjack card game that may be quickly learned by individuals who are familiar with any standard card game. Accordingly, the method utilizes a standard deck of cards, and may be quickly learned by individuals who are already familiar with any standard card game.

It is still another object of the invention to provide a method for playing a modified blackjack card game that, in addition to being enjoyable for a player, is profitable for a casino. Accordingly, the odds of the game provide a player with a good chance to win the game, while also ensuring an overall profit for the casino.

Further objects of the invention will become apparent in the detailed description of the invention that follows.

The invention is a method for playing a modified blackjack card game that utilizes a standard deck of playing cards. The game begins with each of the players placing a bet. The dealer deals a hand of two cards to each of the players and to the dealer. After the dealer has dealt a player a second card, the player can have the dealer replace the second card with a new second card, for an amount equal to a portion of the player's bet, and preferably one-half of the player's bet, thereby giving the player more choices in the game. Moreover, the rules of the game provide for less of a chance of a tie between the dealer and the players, thereby increasing the pace and excitement of the game.

Attention is called to the fact that variations are contemplated as being part of the invention, limited only by the scope of the claims.

DETAILED DESCRIPTION OF THE PREFERRED EMBODIMENTS

The invention is a method for playing a modified blackjack card game, suitable for being played in a casino by a house dealer and multiple players. It utilizes some of the existing rules for playing a "standard" game of blackjack. The modified blackjack card game does, however, have two major differences from a standard game of blackjack. The detailed description will outline the method for playing a standard game of blackjack. The outline will be supplemented, as required, by a detailed description of the two major differences from the existing rules for playing blackjack that are provided in the modified blackjack card game.

A standard game of blackjack is played in a casino with at least one standard deck of playing cards, comprising a plurality of playing cards, each card having a face having either a letter (A, J, Q, or K), or a number ranging between two and ten, and each card further being characterized by a symbol of one of four suits (clubs, spades, hearts, and diamonds) present in the deck of cards. The standard game of blackjack is played by a dealer and by at least one player who wagers on the outcome of the game, as will be described. The dealer represents the "house" or casino. That is, any winnings by the dealer are credited to the casino, as are any such losses. Each of the at least one players competes only against the dealer.

The standard game and the modified blackjack card game each start with the players placing their bets. After all bets have been placed, the dealer deals each player a "hand" of two cards, "face-up". The dealer also receives a hand of two cards, one card "face-down" and one card "face-up". Each of the cards is assigned a "numerical value". The total value of a particular hand is the sum of the numerical values depicted on the faces of the cards. Each of the players has a hand having a value relative to that of the dealer's hand. After the dealer has dealt two cards to each of the players and to himself, each of the players, in turn, must decide whether to be dealt an additional card, or cards, by the dealer.

The decision of the player whether to be dealt an additional card, or cards, by the dealer, is ideally based upon the value of the player's hand, and the supposed value of the dealer's hand. In a standard game of blackjack, an "Ace" is given a value of one or eleven, and a Jack, a Queen, a King, and a card having the number "10" thereupon, are each assigned a value of ten. The cards having numbers from 2–9 have a numerical value equal to said numbers. Furthermore, in a standard game of blackjack, the particular suit of the card has no relevance as to the value of the card. A player wins the game by having a hand having a total value that is greater than the value of the dealer's hand, but less than or equal to a numerical value of twenty-one. In such a case, the dealer must pay to the player an amount of money equivalent to the bet of the player. The player chooses to be dealt an additional card when he/she supposes that this will result in the total value of the player's cards being greater than that of the total value of the dealer's cards, but less than or equal to a numerical value of twenty-one. Using this same rationale, the player may choose to be dealt a third, or even more additional cards. Of course, the player does not have full knowledge of the dealer's hand, because the player is only able to view the value of one of the two cards of the dealer. Accordingly, the player must "guess" the value of the dealer's card that is face down.

A player who is dealt an Ace and a card having an assigned value of "ten" has a hand having a numerical value of twenty-one, which is known as "blackjack". Said player has no need for an additional card. Said player wins the game and is paid back at a ratio of twice the bet of the player.

If, after being dealt one or more additional cards, the total value of the player's cards exceeds the numerical value of twenty-one, this is referred to as a "bust", and the player loses the game and the amount wagered upon the game, even if the total value of the dealer's hand also exceeds the numerical value of twenty-one.

The first major difference between a standard game of blackjack and the modified blackjack card game arises after a player has been dealt a second card. In a standard game of blackjack, after the dealer has dealt a player a second card, the player is "stuck" with that card, and must decide whether to take an additional card based upon the total value of the two cards that have been dealt to the player. This unduly limits the playing options of the players. In the modified blackjack card game, after the dealer has dealt a player a second card, the player has the option of having the dealer replace the second card with a new second card, for a price of half of the player's original bet, thereby giving the player more flexibility. For example, if the player has originally bet $100, the player is able to replace the player's second card with a new second card, by paying the dealer $50. The card that the player returns to the dealer is "discarded" from any future play in that particular game. It is contemplated that the price of replacing the second card with a new second card may be varied.

After each of the players, in turn, has finished taking a card or cards in addition to the two cards originally dealt to the player, it is time for the dealer to play the dealer's hand. The dealer must play his/her hand in a certain way. In particular, the dealer must continue to take additional cards until the numerical value of the dealer's cards is greater than or equal to a chosen number of seventeen, which is lower than the predetermined number, or until the dealer "busts". It is contemplated that the chosen number may be different from the number seventeen, as long as it is at least two numbers lower than the predetermined number.

After the dealer has finished playing the dealer's hand, the value of each of the players' hands is determined, relative to the value of the dealer's hand, in order to determine whether any of the players have won the game. The second major difference between a standard game of blackjack and the modified blackjack card game arises when the value of each of the players' hands is determined, relative to the value of the dealer's hand.

As described above, in a standard game of blackjack, an Ace is given a value of one or eleven, and a Jack, a Queen, a King, and a card having the number "10" thereupon, are each assigned a value of ten. A "push" or tie game occurs when the numerical value of the dealer's hand is equal to the numerical value of the player's hand. This is a frequent occurrence in a standard game of blackjack, as all the Kings, Queens, Jacks, and cards having the number "ten" thereupon are each assigned an equivalent numerical value of ten. A "push" results in neither the dealer nor the player winning the game, and thereby slows down the pace of the game. In the modified blackjack card game, the rules for determining the value of each player's hand relative to the value of the dealer's hand have been changed. In particular, when the dealer and the player each have one or more Kings, Queens, or Jacks, or cards having the number "10" thereupon, and the total numerical value of the dealer's hand is equal to that of the player's hand, the cards having a King, a Queen, a Jack, and any card having the number "10" thereupon are not equal in "actual value", although each has a numerical value of ten. Rather, the King has a higher actual value than a Queen, which has a higher actual value than a Jack, which has a higher actual value than a card having the number "10". These rules of the game provide for less of a chance of a tie between the dealer and the players, thereby increasing the pace and excitement of the game.

By way of example, in a standard game of blackjack, if the dealer has a Jack and a "9", and the player has a Queen and a "9", the hand will be a push, because a Jack and a Queen are equally valued. In contrast, in the modified blackjack card game, if the dealer has a Jack and a "9", and the player has a Queen and a "9", the player would win the game, because although each hand has a numerical value of nineteen, the actual value of the Queen is greater than the actual value of the Jack.

An additional permutation of the modified blackjack card game is described in the following example. If the dealer has a King and a Queen, and the player has a King and a Jack, the game is a push, because only the card having the highest value will determine the winning hand. In this case, since the highest valued card of both the player and the dealer is a King, the game is a push.

It is contemplated that the casino will have the option to change the preceding permutation. In particular, if the player's two cards are a King and a Jack, and the dealer's two cards are a King and a Queen, the casino would have the option of looking at the card having the second highest actual value, in order to break the tie. In this case, the player's card having the second highest actual value is a Jack, which is of lesser value than the dealer's card having the second highest actual value, a Queen, thereby breaking the tie. Accordingly, in this case, the player would loose the game.

The immediately preceding rule is additionally illustrated by the following example. If the player's cards are four, three, and an Ace, and the dealer's cards are five, two, and an Ace, a casino utilizing the modified blackjack card game would generally regard this as a push, because each has an Ace as the highest valued card. However, the casino may optionally choose to look at the value of the second highest card of the player and of the dealer, in an attempt to resolve the tie. Here, the second highest card of the player is a four, and the second highest card of the dealer is a five. In this case, accordingly, the dealer would win the game.

The modified blackjack card game also provides a number of additional optional rules, which may be adopted by a casino. Firstly, if the player has an Ace of spades and a Jack of spades, the modified blackjack card game pays the player at a ratio of 2:1, regardless of the value of the dealer's hand. This is in contrast to a standard game of blackjack, wherein the suit of a card has no bearing on the value of the card. Other variations in the ratio of the payoff to the player for different hands in the event that the player wins the game, are additionally contemplated.

In conclusion, herein is presented a method for playing a modified blackjack card game, suitable for being played in a casino by a house dealer and multiple players. The invention is illustrated by example throughout the written description. It should be understood that numerous variations are possible, while adhering to the inventive concept. Such variations are contemplated as being a part of the present invention.

What is claimed is:

1. A method for playing a modified blackjack card game, by a dealer and by at least one player, for an amount of money, utilizing at least one standard deck of playing cards which includes a plurality of Aces, Kings, Queens, and Jacks, and which also includes a plurality of cards having numbers ranging between two and ten, wherein the dealer and each of the players is dealt a hand comprising at least two cards during the course of the game, wherein each of the cards has an assigned numerical value, wherein the assigned numerical value of the Kings, the Queens, the Jacks, and cards having the number ten thereupon are equivalent to one another, wherein the total numerical value of a particular hand is the sum of the numerical values of the cards which comprise said hand, wherein the game has a predetermined numerical value above which the total numerical value of a player's hand and the dealer's hand may not exceed without losing the game, wherein when the total numerical value of the dealer's hand is equal to that of the player's hand this results in a tied game as between the dealer and said player, unless both the dealer and said player each have a hand having at least one card selected from a group of cards consisting of a King, a Queen, and a Jack, in which case said King, Queen, and Jack are assigned an actual value, in addition to their numerical value, wherein the King has a higher actual value than a Queen, which has a higher actual value than a Jack, which has a higher actual value than a card having the number ten, said method comprising the steps of:

placing a bet by each of the at least one players;

dealing each of the at least one players a hand of cards comprising a first card and a second card, and also dealing the dealer a hand of cards comprising a first card and a second card, one of the cards of the dealer dealt face-down so that the player will not see the value of said card;

winning the game by a player who is dealt a hand equal in value to the predetermined numerical value;

allowing each player the option of having the dealer replace the second card of the player with a new second card, for a price of a portion of the player's original bet, in order to achieve a better hand;

opting by each of the at least one players to receive an additional card from the dealer, when said at least one player believes that this will result in the total value of the player's hand being greater than the total value of the dealer's hand, but less than or equal to the predetermined numerical value;

repeating the immediately previous step by each of the at least one players until said at least one player believes that receiving an additional card will result in the total value of the player's hand exceeding the predetermined numerical value;

losing the game and the amount of the bet by the player if the total value of the player's hand exceeds the predetermined numerical value, even if the total value of the dealer's hand also exceeds the predetermined numerical value;

playing the dealer's hand by the dealer after each of the at least one players, in turn, has finished playing the hand of said player, by the dealer continuing to take additional cards until the numerical value of the dealer's cards is greater than or equal to a chosen number lower than the predetermined numerical value, or until the dealer loses the game by exceeding the predetermined numerical value;

determining the total numerical value of each of the players' hands relative to that of the dealer's hand;

winning the game by the player having a hand having a total numerical value that is greater than the value of the dealer's hand, but less than or equal to the predetermined numerical value;

paying by the dealer to the winning player an amount of money;

losing the game by the player having a hand having a total value that is less than the value of the dealer's hand, or greater than the predetermined numerical value, and thereby forfeiting the amount of the bet of said player to the dealer;

having a tied game in which neither the dealer nor the player win the game, if the total numerical value of the player's hand is equal to that of the dealer's hand, unless the dealer and the player each have a card selected from the group of cards consisting of Kings, Queens, and Jacks;

resolving the tie by comparing the actual value of the King, Queen, or Jack of the player and the dealer;

winning the game by the player if the actual value of the player's hand is greater than the actual value of the dealer's hand;

paying by the dealer to the winning player an amount of money; and losing the game by the player if the actual value of the player's hand is less than the actual value of the dealer's hand, and thereby forfeiting the amount of the bet of said player to the dealer.

2. The method of playing a modified blackjack card game as recited in claim 1, wherein if the total numerical value of the dealer's hand is equal to that of the player's hand, and if the dealer and the player each have at least two cards selected from the group of cards consisting of Kings, Queens, and Jacks, only the card of said two cards having the highest actual value will determine the winning hand.

3. The method of playing a modified blackjack card game as recited in claim 2, wherein each card is further characterized by a symbol of one of four suits, wherein the suits are clubs, spades, hearts, and diamonds, wherein if the first two cards dealt to the player are an Ace of spades and a Jack of spades, the modified blackjack card game pays the player at a ratio of 2:1, regardless of the value of the dealer's hand.

4. The method of playing a modified blackjack card game as recited in claim 3, wherein the predetermined numerical value is twenty-one.

5. The method of playing a modified blackjack card game as recited in claim 4, wherein the second card that the player has returned to the dealer for a replacement card is discarded from any future play in that particular game.

6. The method of playing a modified blackjack card game as recited in claim 5, wherein an Ace has an assigned value of one or eleven.

7. The method of playing a modified blackjack card game as recited in claim 6, wherein a Jack, a Queen, a King, and a card having the number ten thereupon, are each assigned a numerical value of ten.

8. The method of playing a modified blackjack card game as recited in claim 7, wherein the cards having numbers from 2–10 have a numerical value equal to said numbers.

9. The method of playing a modified blackjack card game as recited in claim 1, wherein if the total numerical value of the dealer's hand is equal to that of the player's hand, and if the dealer and the player each have at least two cards selected from the group of cards consisting of Kings, Queens, and Jacks, and if the comparison of the card of said two cards having the highest actual value will not resolve the tie, then the dealer compares the actual value of the card of the at least two cards having the second highest actual value, in order to resolve the tie.

* * * * *